US007025347B2

(12) United States Patent
Masui et al.

(10) Patent No.: US 7,025,347 B2
(45) Date of Patent: Apr. 11, 2006

(54) SHEET ALIGNING APPARATUS

(75) Inventors: Hironori Masui, Tokyo (JP); Kazuhide Sugiyama, Saitama (JP); Jun Tanaka, Saitama (JP)

(73) Assignee: Canon Denshi Kabushiki Kaisha, Saitama-ken (JP)

( * ) Notice: Subject to any disclaimer, the term of this patent is extended or adjusted under 35 U.S.C. 154(b) by 0 days.

(21) Appl. No.: 10/660,624

(22) Filed: Sep. 12, 2003

(65) Prior Publication Data

US 2004/0051232 A1 Mar. 18, 2004

(30) Foreign Application Priority Data

Sep. 17, 2002 (JP) ..... 2002-270125

(51) Int. Cl.
*B65H 9/04* (2006.01)

(52) U.S. Cl. ..... 271/241; 271/245; 271/149

(58) Field of Classification Search ..... 271/10.01, 271/10.09, 10.11, 149, 241, 145, 10.05, 245, 271/246, 157
See application file for complete search history.

(56) References Cited

U.S. PATENT DOCUMENTS 3,586,313 A * 6/1971 Ebeling ..... 271/10.02
3,716,227 A * 2/1973 Bottcher ..... 271/180
4,295,645 A * 10/1981 Nahar et al. ..... 271/34
4,789,148 A * 12/1988 Noguchi et al. ..... 271/94
4,884,795 A * 12/1989 Vander Syde ..... 271/34
4,902,194 A * 2/1990 Lane ..... 414/798.5
4,973,037 A * 11/1990 Holbrook ..... 271/2
4,973,038 A * 11/1990 Curley et al. ..... 271/146
5,954,324 A * 9/1999 Rehberg et al. ..... 271/2
6,055,407 A 4/2000 Inoue et al. ..... 399/381
6,168,146 B1 1/2001 Komuro et al. ..... 271/10.12
6,315,284 B1 11/2001 Komuro et al. ..... 271/127
6,315,286 B1 * 11/2001 Muenchinger et al. ..... 271/146
6,425,579 B1 * 7/2002 Andreyka et al. ..... 271/147
6,557,848 B1 * 5/2003 Hsiao et al. ..... 271/245
6,805,343 B1 * 10/2004 Kosugi ..... 271/147

FOREIGN PATENT DOCUMENTS

GB 2141408 * 12/1984
JP 5-85627 * 4/1993
JP 5-278875 * 10/1993

* cited by examiner

*Primary Examiner*—Donald P. Walsh
*Assistant Examiner*—Thoams Morrison
(74) *Attorney, Agent, or Firm*—Fitzpatrick, Cella, Harper & Scinto

(57) ABSTRACT

A sheet feeding apparatus in which after a bundle of sheets is placed in an erect posture on a sheet supporting stand, the bundle of sheets placed on the sheet supporting stand is continuously vibrated upward and downward for a predetermined time, and is moved in a sheet feeding direction by an aligning portion to be hit against a hitting portion, and the bottom edges and the side edges of the bundle of sheets are accordingly aligned.

11 Claims, 9 Drawing Sheets

SHEET ALIGNING APPARATUS

BACKGROUND OF THE INVENTION

1. Field of the Invention

The present invention relates to a sheet aligning apparatus in a sheet feeding apparatus.

2. Related Background Art

In conventional image reading apparatuses provided in copying machines, facsimile apparatuses, and the like, a sheet feeding apparatus for feeding a sheet to the image reading apparatus is provided. As an example of such a sheet feeding apparatus, there is proposed an automatic document feeding apparatus (ADF) for supplying a sheet of document to a document reading portion.

In such an ADF, a user is required to set documents on its document supporting stand with their leading edges being aligned when the documents are to be read.

However, when the documents are to be set with their leading edges being aligned, all the leading edges of the documents cannot be always aligned in the event that documents with different sizes are contained in a bundle of documents. In such cases, problems of jam, confused sheet feeding order, and the like are likely to occur when the documents are separated and fed out one-by-one. Further, when magnetic ink characters, such as MICR, are written on a document, the relative positional relationship between the reading portion and the magnetic ink character cannot be maintained under a preferable condition if the aligning condition is inappropriate. Accordingly, the problem of inaccurate reading is liable to occur.

Therefore, the user is required to align the documents while confirming sizes of documents in the bundle of documents to prevent the above-discussed problem. Such aligning operation of documents is, however, troublesome, and it is possible that the user will forget such aligning operation.

Conventionally, banks, for example, are equipped with an aligning apparatus in which a bundle of checks, which exemplifies a bundle of sheets, is placed in an erect posture, and aligning and setting operation of the bundle of checks is performed by vibrating it.

FIGS. 9 and 10 illustrate the construction of such an aligning apparatus. In FIGS. 9 and 10, reference numeral 20 designates a main body of the apparatus including therein a vibrating unit (not shown). Reference numeral 23 designates a stand for supporting a bundle of checks 13 thereon. Reference numeral 22 designates a connecting rod one end of which is connected to the vibrating unit of the apparatus main body 20, and the other end of which is connected to the supporting stand 23. Reference numeral 21 designates an operation switch. Upon depressing the switch 21 after the checks 13 are put on the supporting stand 23, the vibrating unit of the apparatus main body 20 vibrates the supporting stand 23 through the connecting rod 22.

When the supporting stand 23 vibrates in such a manner, the checks 13 are continuously hit against alignment faces 24 and 25 of the supporting stand 23. The alignment face 24 is comprised of a wall face of the supporting stand 23, and serves to align the side face of the bundle of checks 13. The alignment face 25 is comprised of a bottom face of the supporting stand 23, and serves to align the bottom face of the bundle of checks 13. The bundle of checks 13 is hence aligned with the alignment faces 24 and 25.

Accordingly, even when the bundle of checks 13 containing checks with different sizes is placed on the supporting stand 23, aligning operation of the individual checks 13 with the alignment faces 24 and 25 can be preferably achieved. Further, air gaps can be generated between the checks during the check aligning operation, and hence the checks 13 can also be loosened.

Therefore, if the sheet feeding apparatus is equipped with the above-discussed aligning apparatus, documents can be assuredly aligned. When the user is to place the documents in such a sheet feeding apparatus, there is no need to align the individual papers and the productivity can be largely increased. No sheet feeding apparatuses equipped with aligning apparatuses can be so far located, and no prior art documents in connection therewith can be hence found.

When such an aligning apparatus is to be provided in a sheet feeding apparatus, there are fears that the document be badly fed in its paper feeding mechanism, and troubles occur in the event that vibration is excessive during the document aligning operation.

Accordingly, the sheet feeding apparatus needs to be constructed such that its sufficient rigidity can be secured and adverse influences due to its vibrating motion can be prevented. However, when the sheet feeding apparatus is constructed in such a manner, its size and cost are likely to increase.

SUMMARY OF THE INVENTION

It is an object of the present invention to provide a sheet aligning apparatus constructed without the above-discussed disadvantages.

It is another object of the present invention to provide a sheet aligning apparatus capable of assuredly aligning sheets without increasing its size and cost, and a sheet feeding apparatus provided with such a sheet aligning apparatus.

These and further aspects and features of the invention will become apparent from the following detailed description of preferred embodiments thereof in conjunction with the accompanying drawings.

DESCRIPTION OF THE PREFERRED EMBODIMENTS

Embodiments of the present invention will hereinafter be described with reference to the drawings. Sizes, materials, shapes or profiles, relative positional relationships, and so forth of constituent components of those embodiments are not limited to those described therein, otherwise specific description thereof is made.

Figure 1:
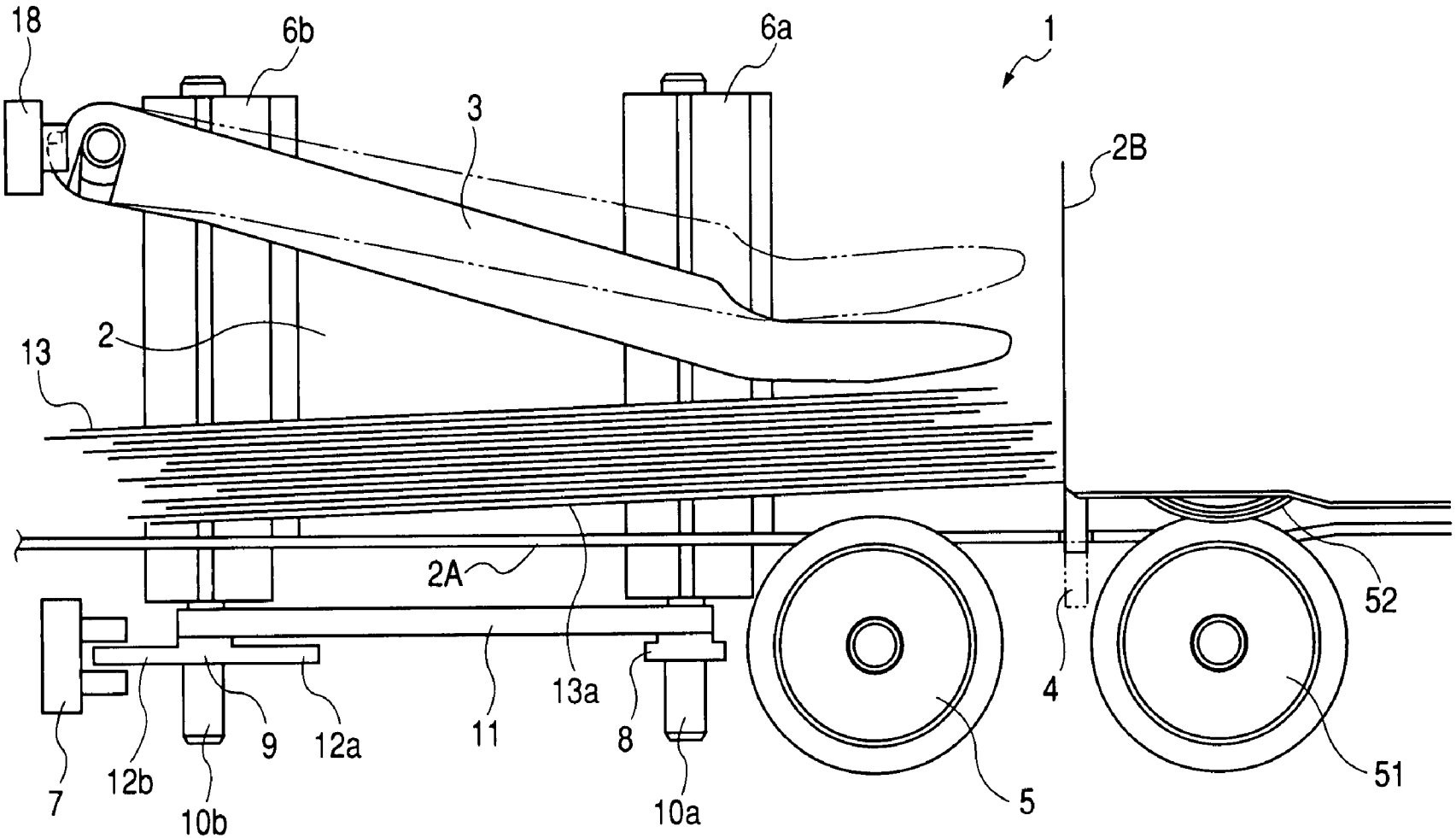
FIG. 1 is a plan view viewed from the above illustrating a document feeding apparatus of a first embodiment according to the present invention.
Figure 2:
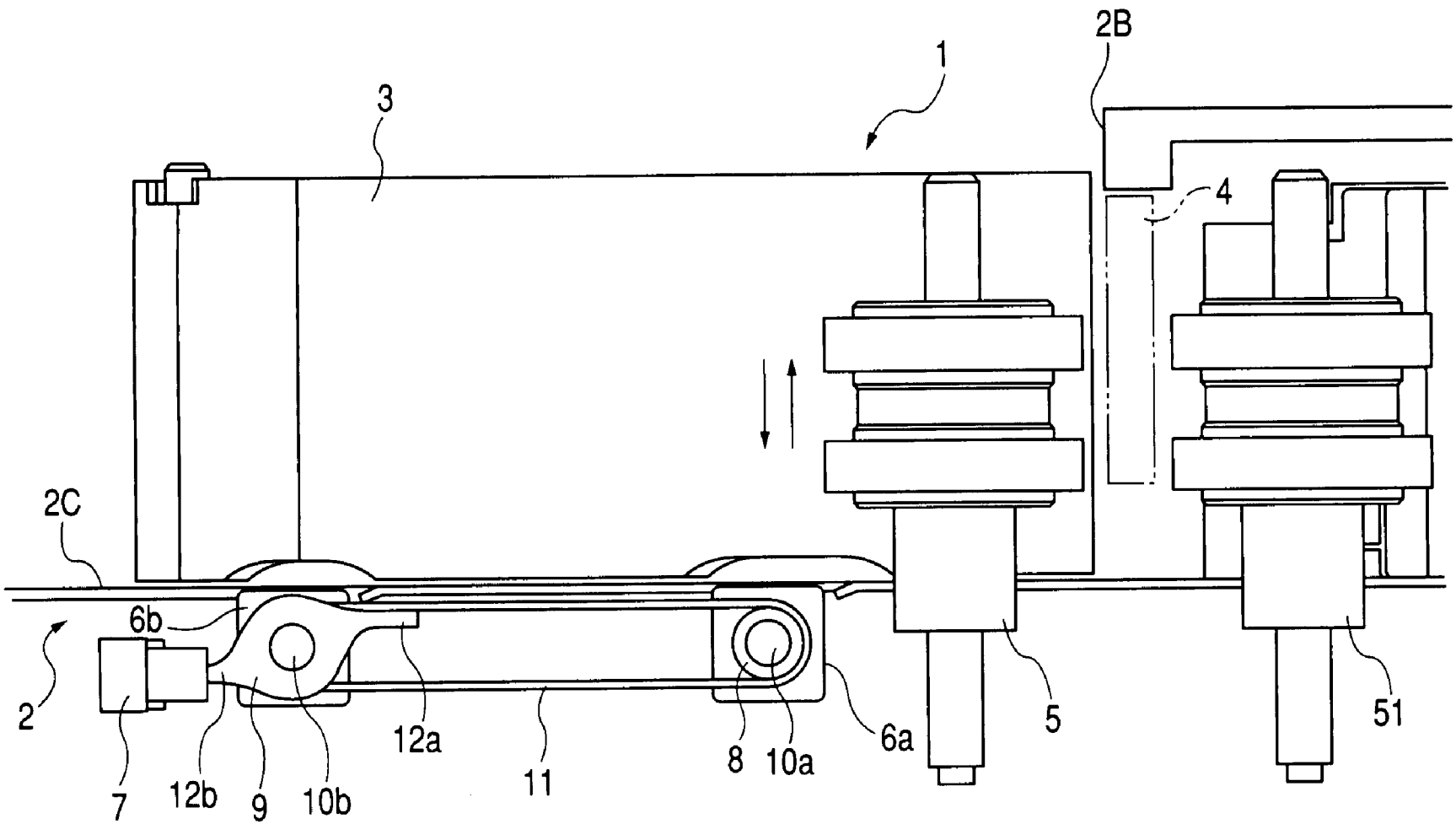
FIG. 2 is a cross-sectional side view of the document feeding apparatus.

FIG. 1 is a plan view viewed from the above illustrating a document feeding apparatus, which exemplifies a sheet feeding apparatus, provided in an image reading apparatus of a first embodiment according to the present invention, and FIG. 2 is its cross-sectional side view.

Figure 7:
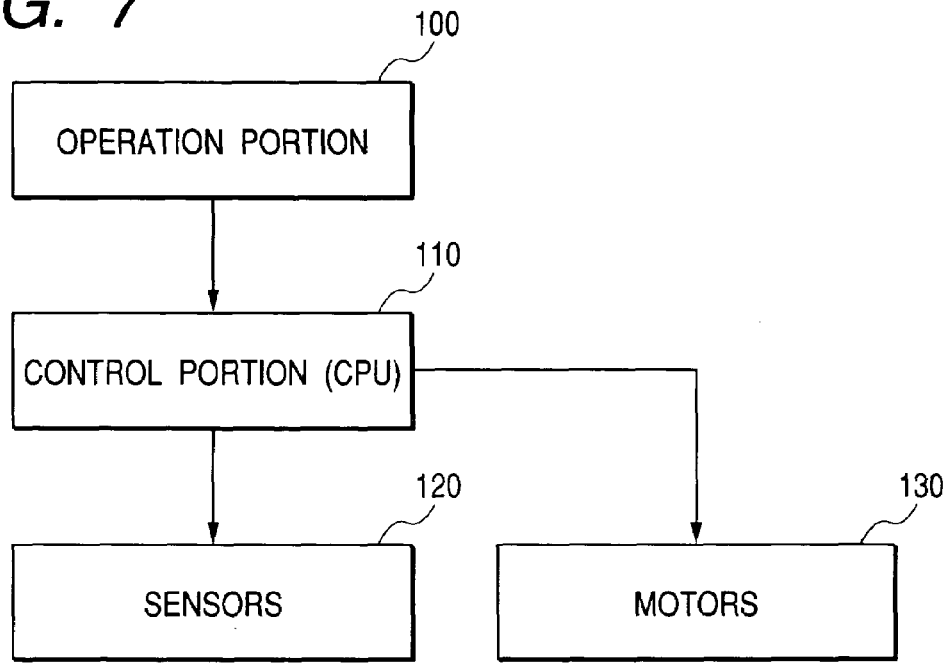
FIG. 7 is a block diagram illustrating a control system of the document feeding apparatus.

Further, FIG. 7 is a block diagram illustrating a control system of the document feeding apparatus. In FIG. 7, reference numeral 100 designates an operation portion. Reference numeral 110 designates a control portion for controlling the document feeding apparatus. Reference numeral 120 designates sensors including a sensor 7 described later. Reference numeral 130 designates motors which may serve as driving portions for driving various movable members such as a pressure plate 3, a shutter 4, and a sheet feeding roller 5 described later.

Reference numeral 4 designates a shutter provided at approximately the same place as the document hitting portion 2B so as to be retractably disposed in a document conveyance path between the feed roller 5 and the separating and feeding portion. As illustrated in FIG. 1, the shutter 4 can be moved from a position indicated by the alternate long and two short dashes line underneath a document supporting surface 2C of the supporting stand 2 to a position indicated by the solid line in which a leading edge of the document 13 hits against the shutter 4, when the bundle of documents 13 is aligned as described later. The document 13 can be prevented from entering the separating and feeding portion by the thus-projected shutter 4 during the aligning operation.

The document supporting stand 2 is used in various ways. In one use situation, as many documents 13 as possible are put on the document supporting stand 2 so as to feed as many documents 13 as possible. In another situation, a very small amount of documents 13 far less than the document supporting capacity of the supporting stand 2 are put and handled on the document supporting stand 2.

Accordingly, to flexibly cope with those situations, the pressure plate 3 is urged toward the aligning wall 2A of the document supporting stand 2 by a biasing unit (not shown), and is movable within a range between positions indicated by the solid line and the alternate long and two short dashes line in FIG. 1 in conformity with the amount of documents 13 when the documents 13 are put on the supporting stand 2. The pressure plate 3 is moved from a position for pushing the documents 13 to the position indicated by the alternate long and two short dashes line by a moving unit (not shown) when document aligning operation (described later) is to be started.

Reference numeral 5 designates a sheet feeding roller (sheet feeding unit) for feeding the documents 13 put on the document supporting stand 2. Reference numerals 51 and 52 respectively designate a feed roller and a retard roller for separating and feeding the documents 13 supplied from the feed roller 5 one by one to an image reading portion (not shown) located downstream of the feed roller 51 and the retard roller 52. Those feed roller and retard roller 51 and 52 constitute a separating and feeding portion. The feed roller 5 is disposed in such a manner that a portion thereof projects from the aligning wall 2A as illustrated in FIG. 1, and is supported movably upward and downward as illustrated in FIG. 2. Reference numeral 2B designates a document hitting portion against which the documents 13 are hit during the document aligning operation described later.

Reference numeral 4 designates a shutter provided at approximately the same place as the document hitting portion 2B so as to be retractably disposed in a document conveyance path between the feed roller 5 and the separating and feeding portion. As illustrated in FIG. 1, the shutter 4 can be moved from a position indicated by the alternate long and two short dashes line underneath a document supporting surface 2C of the supporting stand 2 to a position indicated by the solid line in which a leading edge of the document 13 hits against the shutter 4, when the bundle of documents 13 is aligned as described later. The document 13 can be prevented from entering the separating and feeding portion by the thus-projected shutter 4 during the aligning operation.

When the document 13 is to be fed out after the aligning operation is completed, the shutter 4 is moved from the projecting position indicated by the solid line in FIG. 1 to the position underneath the document supporting surface 2C indicated by the alternate long and two short dashes line in which the shutter 4 is retracted from the conveyance path so as not to interrupt the feed-out of the document 13.

Reference numerals 6*a* and 6*b* designate rotary members which constitute the aligning portion and rotate in the sheet feeding direction to align ends of the documents 13. When the rotary members 6*a* and 6*b* rotate, portions thereof project from the document supporting surface 2C. Due to such rotations of the rotary members 6*a* and 6*b* accompanied with intermittent projections of portions thereof from the document supporting surface 2C, the documents 13 put on the document supporting surface 2C can be dropped after lifted, and the documents 13 can be moved toward the document hitting portion 2B to hit their leading edges against the document hitting portion 2B.

Leading edges and bottom edges of the documents 13 can be aligned due to such motion of the documents 13, i.e., the motion of the documents 13 in which they are continuously vibrated up and down for a predetermined time, and moved in the sheet feeding direction to hit against the hitting portion 2B by the rotary members 6*a* and 6*b*.

Reference numerals 10*a* and 10*b* designate shafts of the two rotary members 6*a* and 6*b*, respectively, and reference numerals 8 and 9 designate pulleys fixed to these shafts 10*a* and 10*b*, respectively. Those two pulleys 8 and 9 are coupled to each other through a belt 11. Rotation of one of the rotary members 6*a* and 6*b* rotated by a gear train (not shown) can be transmitted to the other rotary member through those pulleys 8 and 9, and the belt 11.

Projecting portions 12*a* and 12*b* formed in one pulley 9 are rotated together with rotation of the pulley 9, and interrupt light emitted in a sensor 7 of a light emission and reception type (a photo interrupter) each time the pulley 9 rotates a half rotation.

When the projecting portions 12*a* and 12*b* rotating together with the pulley 9 block the light path of the sensor 7 of the light emission and reception type at a predetermined rotational period, the control apparatus 110 detects the rotational position of the rotary members 6*a* and 6*b* based on electrical signals from the sensor 7 generated corresponding to the light blocking.

When the document feeding apparatus 1 is in its standby state, the rotary members 6*a* and 6*b* do not project from the document supporting surface 2C as illustrated in FIG. 2, and remain stationary in their standby positions retracted under the document supporting surface 2C. At this moment, one of the projecting portions 12*a* and 12*b* interrupts the light path in the sensor 7 of the photo interrupter type. The control apparatus can thus recognize that the rotary members 6*a* and 6*b* are in their standby positions.

In the thus-constructed document feeding apparatus 1, upon depressing the operation switch of the operation portion 100, aligning operation of aligning ends of the documents is initially performed, and thereafter the plural end-aligned documents are separated and fed out one by one, and supplied to the image reading portion (not shown).

Description will now be made of those aligning operation of aligning ends of the documents and document feeding operation.

When the user places a plurality of sheets of documents 13 on the supporting stand 2 and depresses the operation switch of the operation portion 100, the pressure plate 3 is initially retracted from the position indicated by the solid line in FIG. 1 to the position indicated by the alternate long and two short dashes line in FIG. 1 by the moving unit (not shown) such that pressing force against the bundle of documents 13 can be weakened, i.e., such that the aligning operation by the rotary members 6*a* and 6*b* cannot be prevented. Further, the shutter 4 is projected to the position indicated by the solid line in FIG. 1 to close the conveyance path of the documents 13.

Figure 3:
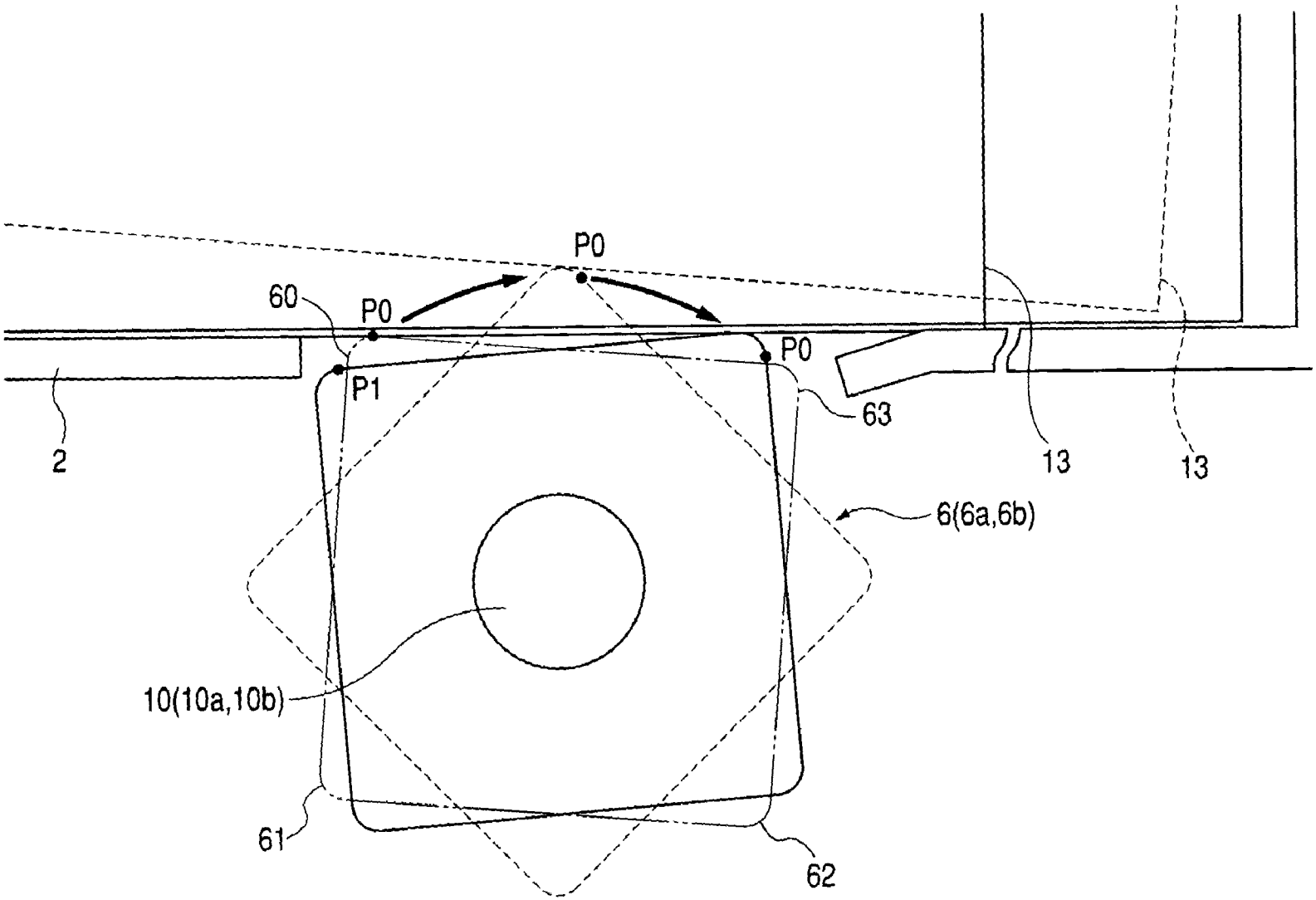
FIG. 3 is a view illustrating a rotary member provided in the document feeding apparatus.

The pressure plate 3 is retracted as discussed above, and the rotary members 6*a* and 6*b* start to be rotated through the gear train (not shown), the two pulleys 8 and 9, and the belt 11. When the rotary members 6*a* and 6*b* are thus rotated, four curved corner portions 60 to 63, which are portions of the rotary members 6*a* and 6*b*, successively project from the document supporting surface 2C to lift the bottom edge of the bundle of documents 13, and then retract as illustrated in FIG. 3.

For example, when the first corner portion 60 projects from the document supporting stand 2, the rotary members 6*a* and 6*b* come into contact with the documents 13 at a point P0 while rotating. After that, the bundle of documents 13 is lifted perpendicularly to the document supporting stand 2 by the rotary members 6*a* and 6*b* during the rotation of the rotary members 6*a* and 6*b*, and is conveyed downstream of the horizontal conveyance path in the sheet feeding direction by friction force between the rotary members 6*a* and 6*b* and the bundle of documents 13. Afterward, when the rotary members 6*a* and 6*b* retract downward underneath the document supporting stand 2, the bundle of documents 13 falls down to the document supporting surface 2C due to the gravity, and is brought to a state moved downstream of the conveyance path.

When the second corner portion 61 located upstream of the first corner portion 60 in the rotational direction then comes into contact with the documents 13 at a point P1 during the rotation of the rotary members 6*a* and 6*b*, the bundle of documents 13 is lifted from the document supporting stand 2 following the rotation of the rotary members 6*a* and 6*b* similar to the case of the first corner portion 60. Then, when the rotary members 6*a* and 6*b* retract downward underneath the document supporting stand 2, the bundle of documents 13 falls down to the document supporting surface 2C, and is brought to a state moved downstream of the conveyance path.

The bundle of documents 13 is thus moved downstream of the conveyance path until its leading edge hits against the hitting portion 2B by the rotation of the rotary members 6*a* and 6*b*.

When the bundle of documents 13 thus reaches the hitting portion 2B and the shutter 4 due to the rotation of the rotary members 6*a* and 6*b*, there can occur a case where a document with a smaller size in the bundle of documents 13 does not yet reach the hitting portion 2B and the shutter 4, for example. Even in such a case, however, the document with a smaller size can be gradually conveyed downstream of the conveyance path toward the hitting portion 2B and the shutter 4 by the above-discussed operation to be successively executed afterward.

The documents having already arrived at the hitting portion 2B and the shutter 4 repeat the following motion while being prevented from moving forward by the hitting portion 2B and the shutter 4. In such motion, after lifted above the document supporting surface 2C by the motion of the rotary members 6*a* and 6*b*, the documents are dropped again.

The bundle of documents. 13 can be sufficiently aligned with the document supporting surface 2C by the above-discussed repetitive vibrations (lifting and dropping) of the bundle of documents 13. At the same time, sticking force generated between the documents is eliminated, and air gaps are created between the documents. The documents can be thereby loosened. The following separating and feeding operation of the documents can be smoothly achieved due to the effect of such loosening operation. Further, even when documents with different sizes are contained in the bundle of documents 13, leading edges of the individual documents 13 can be aligned due to continuous hitting motion of the bundle of documents 13 against the hitting portion 2B and the shutter 4.

Afterward, the rotary members 6*a* and 6*b* are rotated for such a period that all the documents are sufficiently aligned with the document hitting portion 2B, the shutter 4, and the document supporting surface 2C, and the documents repeat the above-discussed motion for a predetermined period. Then, the control apparatus controls the rotary members 6*a* and 6*b* to stay in the standby positions which are detected by the above-mentioned sensor 7 of the photo interrupter type.

For example, the control apparatus counts the number of interruptions of the optical path in the sensor 7 by the protruding portions 12*a* and 12*b* of one pulley 9, and stops the rotation of the rotary members 6*a* and 6*b* when the counted value reaches a predetermined value. At the same time, the control apparatus retracts the shutter 4 from the document supporting stand 2 back to the position indicated by the alternate long and two short dashes line in FIG. 1. The operation for aligning the ends of the documents is thus finished. At this moment, the rotary members 6*a* and 6*b* are stopped at positions retracted from the document supporting surface 2C as illustrated in FIG. 2.

After completion of the above-discussed aligning operation of aligning ends of the documents, the bundle of documents 13 is fed out by the feed roller 5 as discussed above. Afterward, the documents are separated and conveyed one by one by the feed roller 51 and the retard roller 52. All the operations are completed after all the documents are fed out from the document supporting stand 2.

As described in the foregoing, after the bundle of documents 13 is placed in an erect posture on the document supporting stand 2, the bundle of documents 13 is continuously vibrated up and down for a predetermined time, and is moved in the sheet feeding direction by the rotary members 6*a* and 6*b*. The bundle of documents 13 is hence hit against the document hitting portion 2B and the shutter 4. The ends of the bundle of documents 13 can be thus aligned by a simple structure.

Further, size, weight, and space of the document feeding apparatus or sheet supplying apparatus can be reduced, and the apparatus can be produced at relatively low costs.

Figure 4:
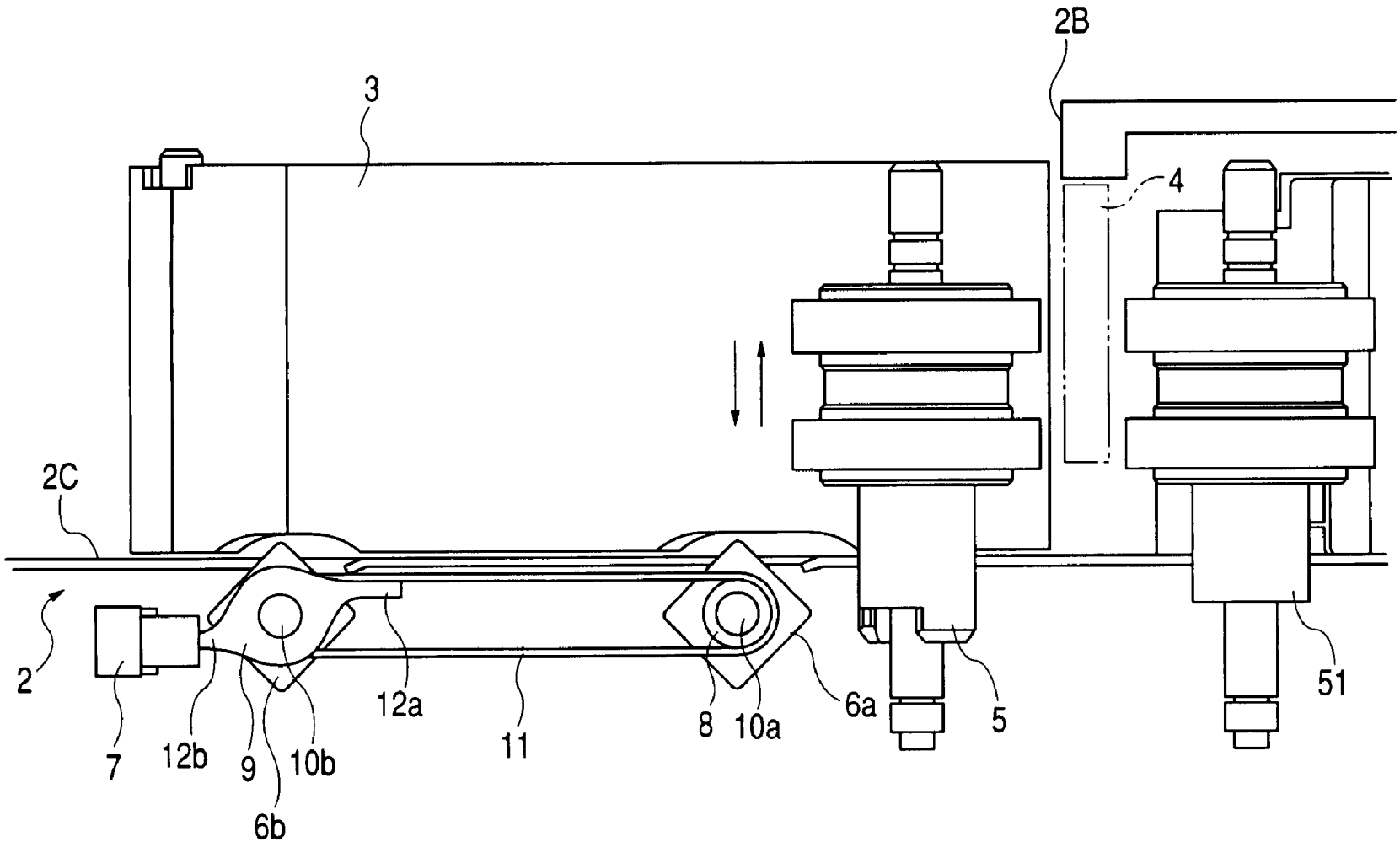
FIG. 4 is a view illustrating another example of a rotary member which is in a standstill state.

In the above-discussed structure, the standby state is established when the two rotary members 6*a* and 6*b* are retracted from the document supporting stand 2. However, it is possible to establish the standby state when portions (corner portions) of the rotary members 6*a* and 6*b* are projected from the document supporting stand 2 as illustrated in FIG. 4. In such a construction, projecting portions 12*a* and 12*b* are formed in one rotary member 6*b* such that either of projecting portions 12*a* and 12*b* can interrupt the optical path in the sensor 7 of the photo interrupter type when the rotary member 6*b* stays in the standby state illustrated in FIG. 4.

In such a structure where the standby state is established when the two rotary members 6*a* and 6*b* project by the same height from the document supporting stand 2, but not when the two rotary members 6*a* and 6*b* are retracted from the document supporting stand 2, the bundle of documents 13 can be kept in such a posture that does not adversely influence subsequent feeding operation even if the document supporting surface 2C has an uneven portion. Further, the bundle of documents 13 can be kept under a more appropriate condition by finely adjusting the amount of the above projection.

The two rotary members 6*a* and 6*b* are projected by the same height in the above structure to maintain the bundle of documents in such a posture that does not adversely influence the feeding operation, but the structure is not limited thereto. For example, in the event that the document supporting surface 2C is sloped, it is possible to establish the standby state when the two rotary members 6*a* and 6*b* project by different heights from the document supporting stand 2, and keep the bundle of documents 13 under a slant condition relative to the document supporting surface 2C.

Figure 5A:
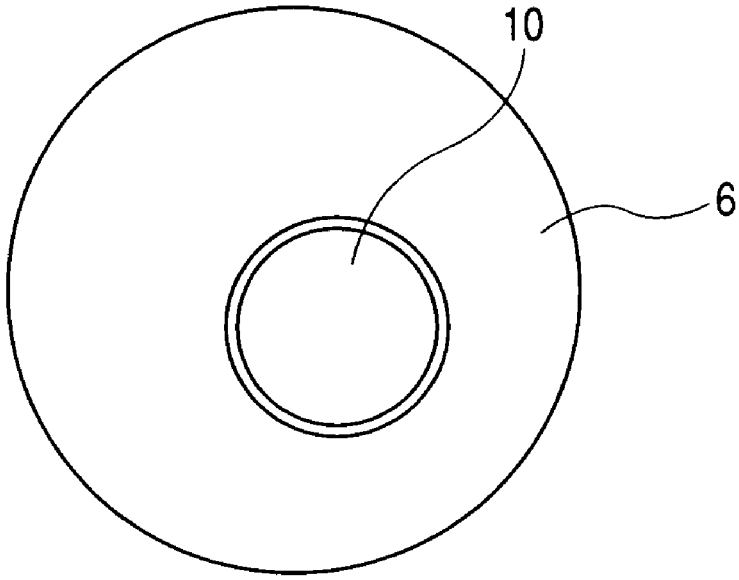
FIGS. 5A and 5B are views exemplifying shapes or profiles of rotary members, respectively.
Figure 5B:
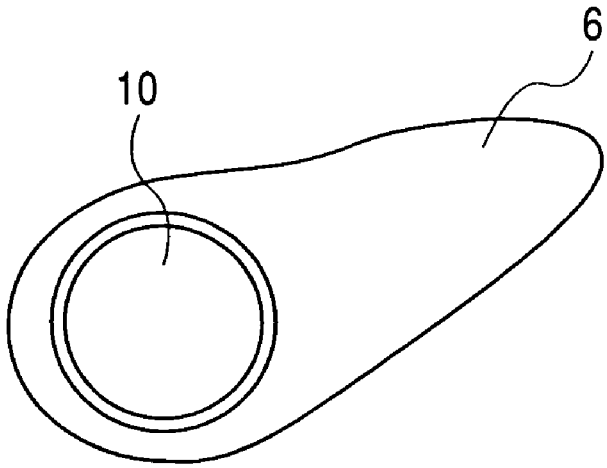

Furthermore, in the above-discussed structure, square-shaped rotary members 6*a* and 6*b* with four corners are used as the aligning portion that repeats projection and retraction from the document supporting surface 2C, but the rotary member is not limited thereto. The shape or profile of the rotary member 6 can be an eccentric cylinder as illustrated in FIG. 5A, or a cam shape as illustrated in FIG. 5B. The above-discussed appropriate height position and slope direction of the bundle of documents can be finely set by using the rotary members with those shapes.

Figure 6A:
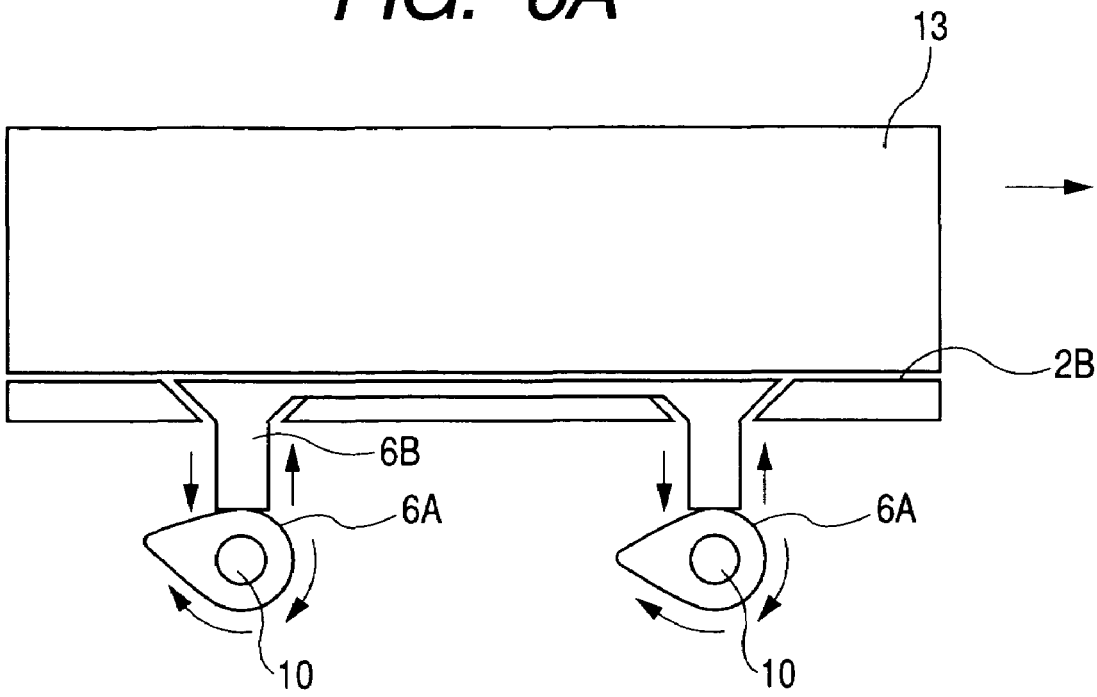
FIGS. 6A and 6B are views illustrating another constructions of aligning portion, respectively.
Figure 6B:
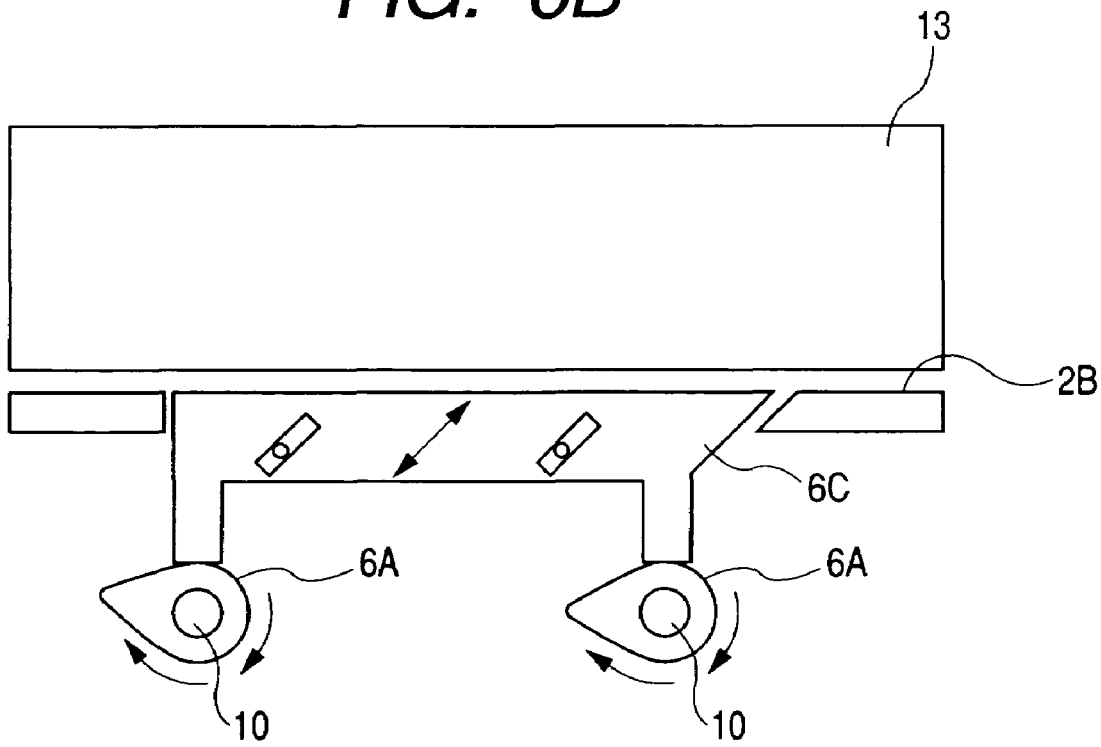

Further, the aligning portion is not limited to the above-discussed rotary member 6. The following aligning portion can also be used. One example includes a cam member 6A and a vibrating member 6B as illustrated in FIG. 6A, and the vibrating member 6B is adapted to repeat projection and retraction from the document supporting surface 2C according to the profile of the cam member 6A. Another example includes a cam member 6A and a vibrating member 6C as illustrated in FIG. 6B, and the vibrating member 6C is adapted to repeat slant-moving projection and retraction from the document supporting surface 2C according to the profile of the cam member 6A.

In the structure illustrated in FIG. 6A, phases of the cam members 6A can be made different from each other such that the vibrating member 6B can move up and down in a slant posture so as to guide the bundle of documents 13 toward the shutter 4 as indicated by the arrow.

When the up and down movement of the vibrating members 6B and 6C is effected by the above-discussed cam member 6A, it is possible to preferably achieve the aligning operation of aligning ends of the bundle of documents 13 by moderate vibration. Such structures are effective particularly when the document is thin, and is hence likely to bend.

The aligning operation of aligning edges of the documents can be more effectively executed when the user can appropriately set at least one of operation conditions, such as operation time of the aligning operation, the number of projection and retraction movements of the rotary member 6 and the vibrating members 6B and 6C (the number of vibrations of the bundle of documents 13), speed thereof, and an amplitude of the up and down vibration of the bundle of documents 13, in conformity with conditions such as the amount of the bundle of documents 13, and quality of paper.

Further, when the amount of the bundle of documents 13 is detected by a sensor or the like such that operation conditions can be automatically set in conformity with the detected amount, the user need not make troublesome selection of appropriate operation conditions according to the amount of the bundle of documents 13. Operability of the apparatus can be hence remarkably improved.

Figure 8:
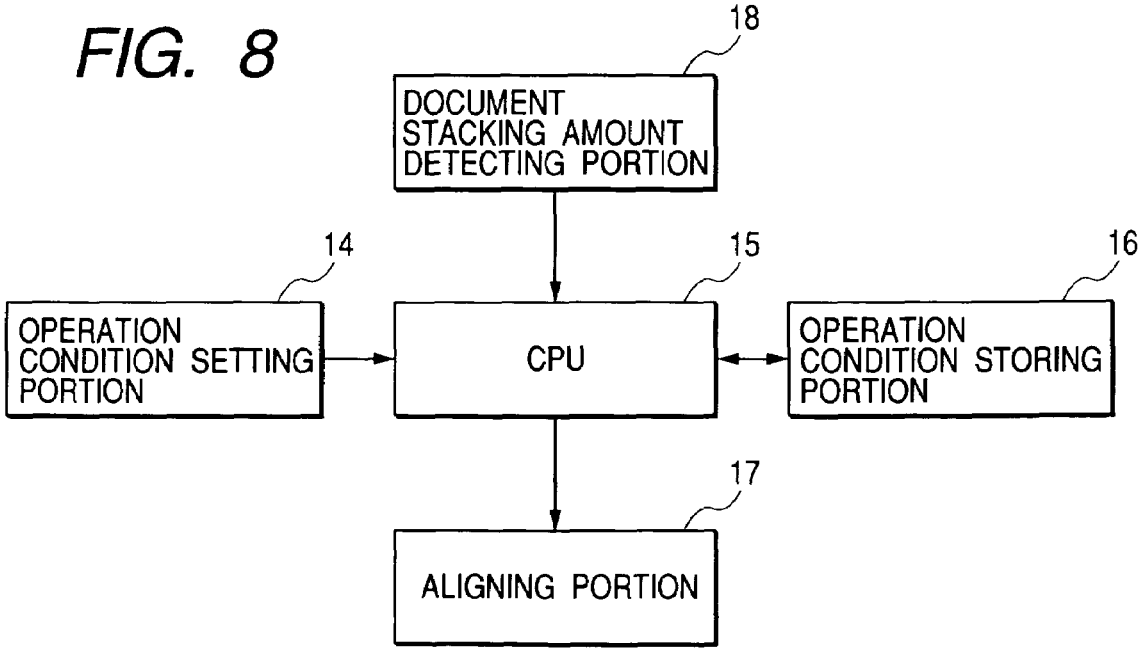
FIG. 8 is a block diagram illustrating a control system of a document feeding apparatus of a second embodiment according to the present invention.
Figure 9:
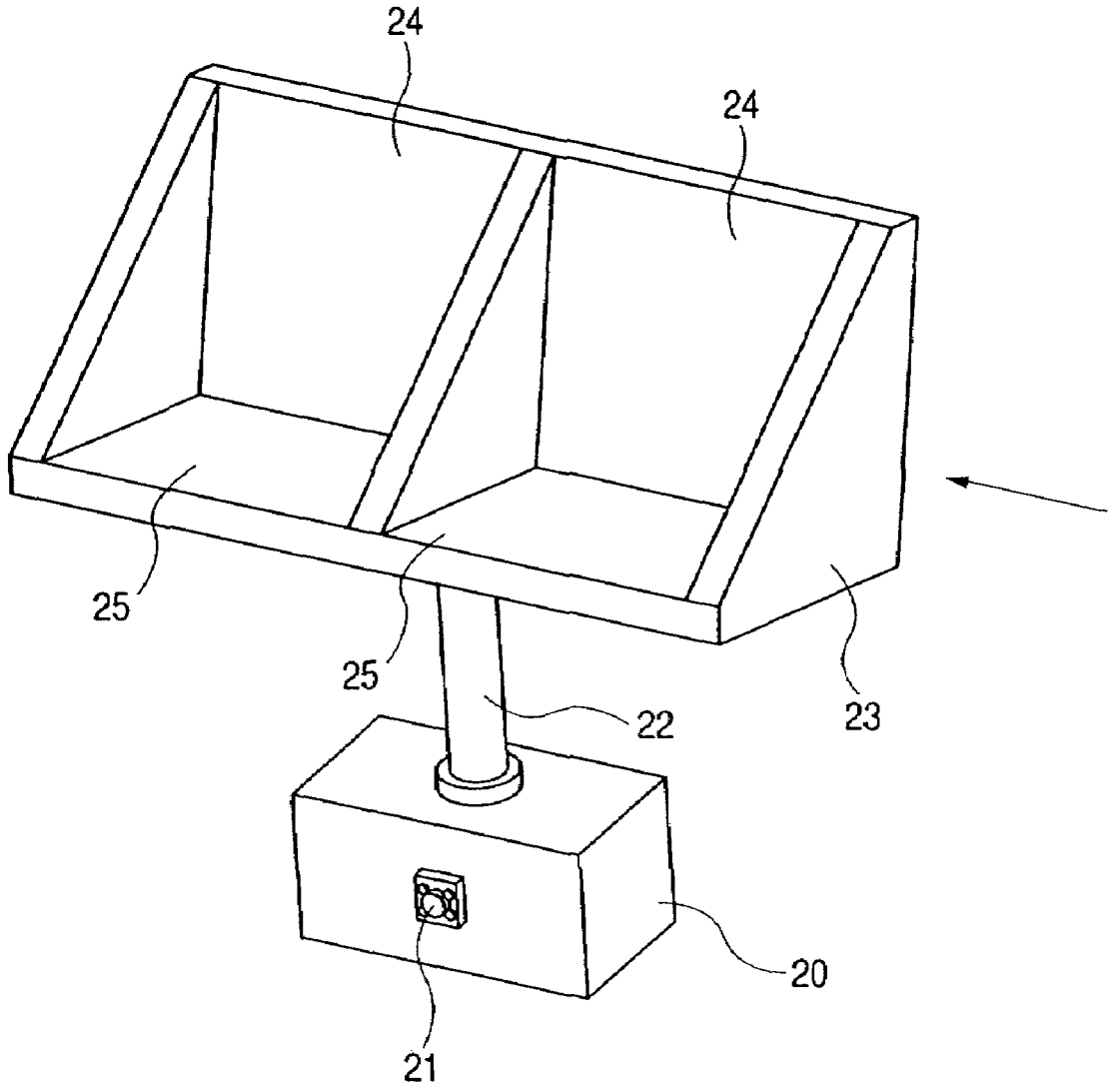
FIG. 9 PRIOR ART
FIG. 9 is a perspective view illustrating a conventional aligning apparatus.
Figure 10:
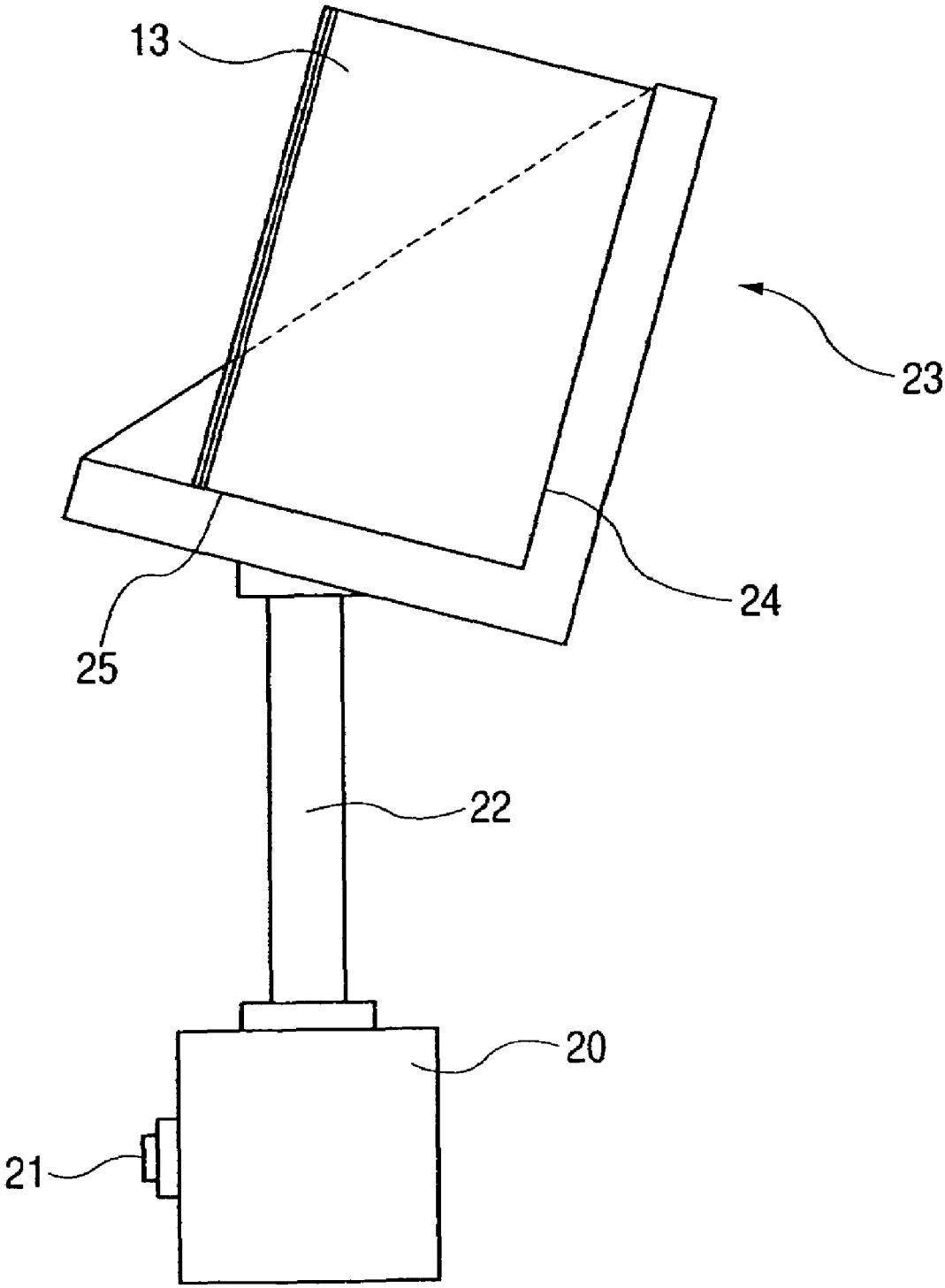
FIG. 10 PRIOR ART
FIG. 10 is a cross-sectional side view illustrating the conventional aligning apparatus.

FIG. 8 is a block diagram illustrating a control system in a sheet feeding apparatus of a second embodiment of the present invention, in which operation conditions can be automatically set in conformity with the amount of the bundle of documents 13. In FIG. 8, reference numeral 14 designates an operation condition setting portion by which the user can appropriately set operation conditions, such as operation time of the aligning operation, the number of projection and retraction movements of the rotary member and the vibrating member, and speed thereof, in conformity with conditions such as the amount of the bundle of documents 13, and quality of paper. Reference numeral 16 designates an operation condition storing portion for storing the operation conditions appropriately set by the user. Reference numeral 15 designates a CPU, and reference numeral 17 designates an aligning portion described using FIGS. 1 to 7 in the foregoing.

The CPU 15 serves to cause the operation condition storing portion 16 to hold information set by the operation condition setting portion 14, and also serves to supply electrical signals of the stored operation conditions to the aligning portion 17 when the aligning operation is to be performed, and cause the aligning portion 17 to perform the operation of aligning ends of the documents (the aligning operation). The operation condition storing portion 16 thus holds the once-set operation conditions, and therefore there is no need to newly set the conditions since the stored set conditions can be called for subsequent operation.

Further, in FIG. 8, reference numeral 18 designates a document stacking amount detecting portion that is a detecting unit for detecting the amount of the documents 13 placed on the document supporting stand 2. The CPU 15 acting as a changing unit can change at least one of the above-discussed operation conditions in conformity with the detected amount.

The document stacking amount detecting portion 18 has a structure in which the amount of the documents 13 is detected by detecting a held position of the pressure plate 3 as illustrated in FIG. 1, for example. The CPU 15 can recognize the amount of the documents based on an electrical signal corresponding to such held position.

In such a construction, the CPU 15 can automatically set at least one of the above operation conditions in conformity with the detected amount of the documents 13, and accordingly the user need not make troublesome selection of appropriate operation conditions according to the amount of the bundle of documents 13. Operability of the apparatus can be hence remarkably improved.

In the above-discussed operation setting, the operation of aligning edges of the documents, and the document feeding operation are sequentially performed automatically. The present invention, however, is not limited thereto. It is also possible to perform only the document feeding operation unless the user desires to execute the aligning operation, or perform only the aligning operation. Such selection can be appropriately made, and is stored in the operation condition storing unit 16 from the operation condition setting portion 14 through the CPU 15.

In the construction where the aligning operation can be thus selectively performed, the document feeding operation can be directly executed when there is no need to align the documents, for example, when documents with the same size are put on the supporting stand. Further, when the user desires to align the bundle of documents beforehand prior to storage, conveyance or transportation of the documents, it is possible to perform only the aligning operation. Efficiency can be hence increased.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A sheet feeding apparatus comprising:

a sheet supporting stand which supports a bundle of sheets in an erect posture;

a sheet feeding portion which feeds the bundle of sheets supported by said sheet supporting stand;

a pressure portion which thrusts the bundle of sheets toward said sheet feeding portion during feeding by said sheet feeding portion;

an aligning portion which vibrates the bundle of sheets upward and downward and moves the bundle of sheets in a sheet feeding direction while supporting the bundle of sheets at at least two locations of said sheet supporting stand; and a hitting portion arranged to be hit against leading edges of the bundle of sheets moved by said aligning portion, wherein said pressure portion is moved by a driving portion under control of a control portion so as to weaken a pressing force exerted on the bundle of sheets during an aligning operation of said aligning portion.

2. A sheet feeding apparatus according to claim 1, wherein said aligning portion includes vibrating members for vibrating the bundle of sheets by repeatedly lifting at least two locations of a bottom portion of the bundle of sheets.

3. A sheet feeding apparatus according to claim 2, wherein said vibrating members are rotary members to be rotated in the sheet feeding direction, and a height of a portion of said rotary members projecting from a surface of said sheet supporting stand is adapted to change in accordance with a rotational angle of said rotary members, and said vibrating members are retracted to a position in which the portion of said rotary members does not project from the surface of said sheet supporting stand during a non-aligning operation of said aligning portion.

4. A sheet feeding apparatus according to claim 3, wherein said rotary members have an eccentric cylindrical shape.

5. A sheet feeding apparatus according to claim 3, wherein said rotary members have a cam shape.

6. A sheet feeding apparatus according to claim 1, wherein said aligning portion is adapted to remain stationary in a position in which said aligning portion is retracted from said sheet supporting stand, or in a position in which a portion of said aligning portion projects from said sheet supporting stand, when said aligning portion does not align the bundle of sheets.

7. A sheet feeding apparatus according to claim 1, wherein said hitting portion has a shutter retractable in a direction perpendicular to the sheet feeding direction, and said shutter is moved to a position in which said shutter does not hinder movement of the sheets during a sheet feeding operation of said sheet feeding portion, while said shutter is projected into an alignment position to hit against the sheets moved by said aligning portion and block the movement of the sheets during the aligning operation of said aligning portion.

8. A sheet feeding apparatus according to claim 1, further comprising a setting portion arranged to set at least one of operation time of said aligning portion, the number of the vibrations of the bundle of sheets, and a vertical amplitude of the vibrations of the bundle of sheets.

9. A sheet feeding apparatus according to claim 1, further comprising:

a detecting portion arranged to detect the amount of the sheets placed on said sheet supporting stand; and a changing portion arranged to change at least one of operation time of said aligning portion, the number of the vibrations of the bundle of sheets, and a vertical amplitude of the vibrations of the bundle of sheets in accordance with the amount detected by said detecting portion.

10. A sheet feeding apparatus according to claim 1, further comprising a selecting portion by which a user selects a mode in which the bundle of sheets aligned by the aligning operation is not automatically fed by said sheet feeding portion after the aligning operation by said aligning portion.

11. A sheet feeding apparatus according to claim 1, further comprising a separating portion arranged to separate sheets one by one from the bundle of sheets after the aligning operation by said aligning portion.

* * * * *

UNITED STATES PATENT AND TRADEMARK OFFICE

CERTIFICATE OF CORRECTION

PATENT NO. : 7,025,347 B2
APPLICATION NO. : 10/660624
DATED : April 11, 2006
INVENTOR(S) : Hironori Masui et al.

It is certified that error appears in the above-identified patent and that said Letters Patent is hereby corrected as shown below:

On Title Page col. 1 ITEM [73]:
Assignee, "Canon Denshi Kabushiki Kaisha, Saitama-ken (JP)" should read --Canon Denshi Kabushiki Kaisha, Chichibu (JP)--.

COLUMN 3:
Line 25, insert --In Figs. 1 and 2, reference numeral 1 designates a document feeding apparatus provided in an image reading apparatus (not shown). Reference numeral 2 designates a document or sheet supporting stand on which documents 13 or sheets are placed in an erect or upstanding state. The document supporting stand 2 is provided with the pressure plate 3 for holding the documents 13 in an erect posture, and thrusting the documents 13 against an aligning wall 2A such that the documents 13 are not put in disorder.--.

Lines 26-37 should be deleted.
Line 42, "amount" should read --number--.

COLUMN 4:
Line 33, "after" should read --after being--.

COLUMN 5:
Line 11, "operation" should read --operations--.

COLUMN 8:
Line 56, "amount" should read --number--.
Line 59, "amount" should read --number--.

Signed and Sealed this

Seventh Day of November, 2006

JON W. DUDAS
*Director of the United States Patent and Trademark Office*